US006331137B1

(12) United States Patent
Raeder et al.

(10) Patent No.: US 6,331,137 B1
(45) **Date of Patent: *Dec. 18, 2001**

(54) POLISHING PAD HAVING OPEN AREA WHICH VARIES WITH DISTANCE FROM INITIAL PAD SURFACE

(75) Inventors: Christopher H. Raeder; Kevin Shipley, both of Austin, TX (US)

(73) Assignee: Advanced Micro Devices, Inc, Sunnyvale, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,046

(22) Filed: Aug. 28, 1998

(51) Int. Cl.[7] ..... B24B 7/24

(52) U.S. Cl. ..... 451/285; 451/527; 451/528; 451/530; 451/921

(58) Field of Search ..... 451/41, 527–530, 451/921, 285–289

(56) References Cited

U.S. PATENT DOCUMENTS 5,020,283 6/1991 Tuttle .
5,297,364 3/1994 Tuttle .
5,441,598 8/1995 Yu et al. .
5,645,469 7/1997 Burke et al. .
5,655,951 8/1997 Meikle et al. .
5,725,420 3/1998 Torii .
5,853,317 * 12/1998 Yamamoto ..... 451/41
5,876,271 * 3/1999 Oliver ..... 451/41
5,882,251 * 3/1999 Berman et al. ..... 451/527
5,984,769 * 11/1999 Bennett et al. ..... 451/527

FOREIGN PATENT DOCUMENTS 0 304 645 A2 3/1989 (EP) .

* cited by examiner

*Primary Examiner*—David A. Scherbel
*Assistant Examiner*—George Nguyen

(57) ABSTRACT

A polishing pad having a cross-sectional open area which varies with depth from the pad surface is provided. The cross-sectional open area of the pad may increase and/or decrease moving away from the outer pad surface. In some cases, the cross-sectional open area of the pad varies uniformly with depth over the entire pad. In other cases, certain regions of the pad may define local cross-sectional open areas which vary differently. This can, for example, allow the open area of the pad to vary with pad life and improve or tailor the polishing uniformity of the pad and/or extend the useful life of the pad.

23 Claims, 6 Drawing Sheets

POLISHING PAD HAVING OPEN AREA WHICH VARIES WITH DISTANCE FROM INITIAL PAD SURFACE

FIELD OF THE INVENTION

The present invention relates generally to the planarization of semi-conductor wafers and, more specifically to a polishing pad having a cross-sectional open area which varies with distance from the initial pad surface

BACKGROUND OF THE INVENTION

Chemical-mechanical polishing (CMP) is a widely used means of planarizing silicon dioxide as well as other types of surfaces on semiconductor wafers. Chemical mechanical polishing typically utilizes an abrasive slurry disbursed in an alkaline or acidic solution to planarize the surface of the wafer through a combination of mechanical and chemical action.

FIG. 1 illustrates one type of chemical mechanical polishing (CMP) system. The CMP system 100 includes a rotatable circular platen or table 102 on which a polishing pad 104 is mounted. A single or multi-head polishing device 106 is positioned above the table 102. The polishing device 106 has a single or multiple rotating carrier heads 108 to which wafers can be secured typically through the use of vacuum pressure. Typically, the polishing pad 104 includes a bottom pad 110 mounted on the platen 102 and a top pad 112 mounted on the bottom pad 110. Typically, the top pad 112 is adhered to the bottom pad 110 using a glue. The bottom pad 110 serves as a damper and typically is formed from foam or felt. The top pad 112 generally contacts the wafer for polishing and is typically formed from polyurethane.

In use, the platen 102 is rotated and an abrasive slurry is disbursed onto the polishing pad 104 of the platen 102. Once the slurry has been applied to the polishing pad 104, the rotating carrier heads 108 move downward to press their corresponding wafers against the polishing pad 104. As the wafer is pressed against the polishing pad 104, the surface of the wafer is mechanically and chemically polished. Between polishing runs, the polishing pad 104 is typically conditioned. Conditioning typically includes applying a conditioning tool, such as a diamond impregnated steel plate, to the top pad 112 to remove expired surface and expose fresh pad material.

A significant goal relating to chemical-mechanical polishing techniques is the maintenance of substantially uniform removal rate over the entire surface of a given wafer. The uniformity or nonuniformity of a wafer is typically measured using the relationship: $\sigma/R$, where R is the average removal amount over a number of different locations on a wafer and $\sigma$ is the standard deviation of the removal amounts. The polishing uniformity of a polishing pad may also be measured using the relationship $\sigma/R$ for wafers polished by the pad over time. By way of example, FIG. 2 is a graph illustrating polishing uniformity as a function of pad life for a typical polishing pad. As can be seen, the polishing uniformity typically starts poorly in a period of time known as the break-in period. This typically results from the pad polishing the center of a wafer slower or faster than the edges. After the break-in period, the polishing uniformity reaches an optimum level and flattens out for a period of time. This time period is commonly referred to as the useful life of the pad. At the end of the useful life, the polishing uniformity declines, again usually resulting from the pad polishing wafer centers faster or slower than the edges.

SUMMARY OF THE INVENTION

The present invention generally provides a polishing pad having a cross-sectional open area which varies with depth from the pad surface. This can, for example, allow the open area of the pad to vary with pad life and increase the polishing uniformity and/or extend the useful life of the pad.

A polishing pad, in accordance with one embodiment of the invention, includes a pad having an outer surface and defining a cross-sectional open area which varies with distance from the outer surface. The cross-sectional open area of the pad may increase and/or decrease moving away from the outer pad surface. In some cases, the cross-sectional open area of the pad varies uniformly with depth over the entire pad. In other cases, certain regions of the pad may define local cross-sectional open areas which vary differently.

A method of polishing wafers, in accordance with an embodiment of the invention, includes providing a polishing pad having an outer surface and defining a cross-sectional open area which varies with distance from the outer surface. One or more wafers are polished using the polishing pad at a first cross-sectional open area. A portion of the polishing pad is then removed to expose a second cross-sectional open area different than the first cross-sectional open area, and one or more wafers are polished at the second cross-sectional open area. The removal of portions of the polishing pad typically occurs through conditioning of the pad between one or more polishing runs.

The above summary of the present invention is not intended to describe each illustrated embodiment or implementation of the present invention. The Figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
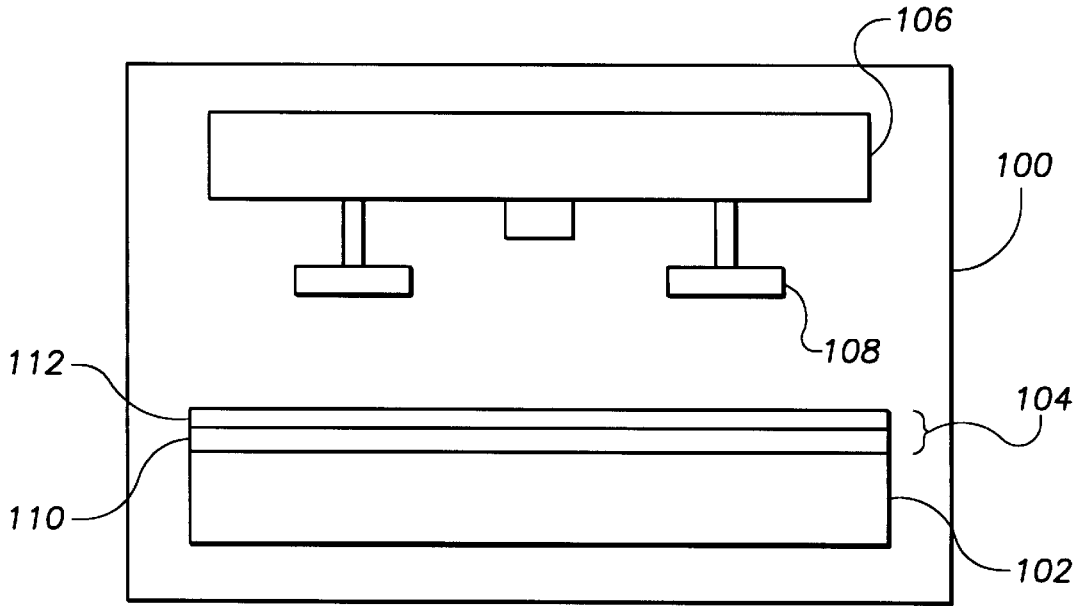
FIG. 1 PRIOR ART
FIG. 1 illustrates a typical multi-head polishing tool.
Figure 2:
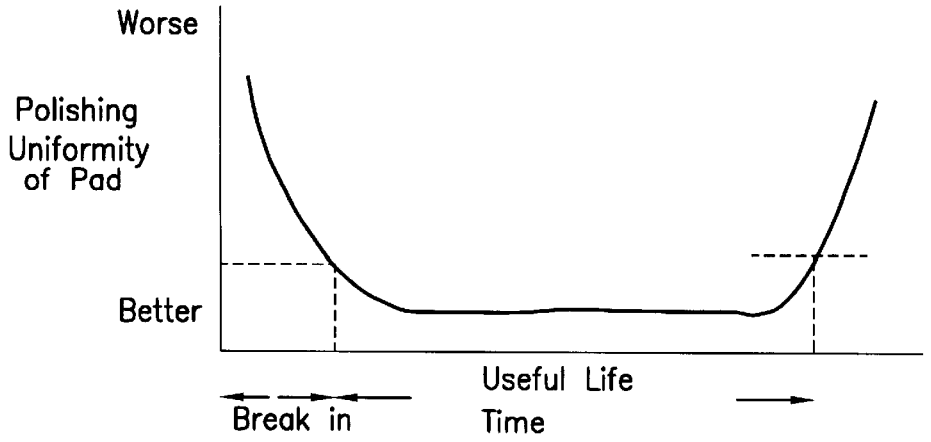
FIG. 2 PRIOR ART
FIG. 2 is a graph illustrating the polishing uniformity of a conventional pad over the life of the pad.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a number of types of polishing or planarization (hereinafter "polishing" systems) which employ pads for polishing semiconductor wafers. As used herein, the terms "semiconductor wafer" and "wafer" are used interchangeably and are intended to include wafer substrates as well as wafers having any number of layers. The invention has been found to be particularly advantageous in chemical-mechanical polishing (CMP) applications. While the present invention is not so limited, an appreciation of various aspects of the invention will be gained through the discussion below.

As noted above, the present invention generally provides a polishing pad having a cross-sectional open area which varies with depth from the pad surface. Thus, in use, as the pad is conditioned, the open area of the pad varies. The particular manner in which the open area of the pad varies can be tailored to the polishing process in order to increase the useful life of the pad and/or improve the polishing uniformity of the pad. For instance, the open area of the pad or a region of the pad can be increased to improve slurry distribution, e.g., by providing reservoirs in which the slurry may flow. On the other hand, the open area of the pad or region of the pad can be decreased in order to provide a larger pad area for polishing a wafer. For example, in some cases, slurry may not be delivered to the center of a wafer near the end of a pad's life thus reducing the uniformity of planarization. To address this, the open area of a pad may be increased near the end of the pad's useful life to improve slurry distribution and thereby improve the planarization efficiency of the pad and extend the pad's life.

Figure 3:
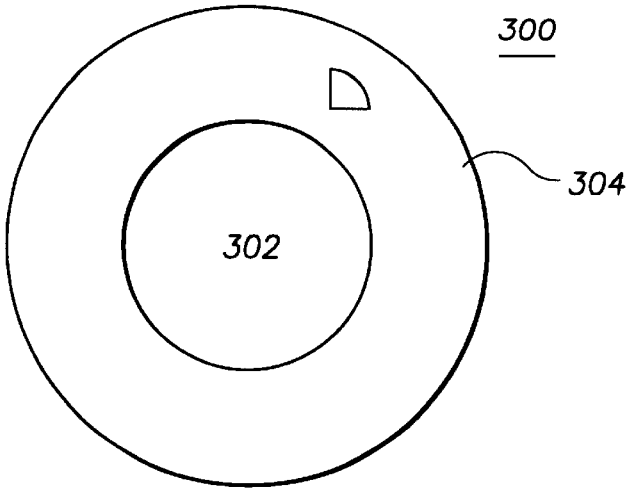
FIG. 3 illustrates an exemplary pad in accordance with an embodiment of the invention.

FIG. 3 illustrates an exemplary pad having a cross-sectional open area which varies with depth from the pad surface. While the invention is not limited to any type of polishing pad, the polishing pad 300 may, for example, be the top pad of a dual-pad structure which is mounted on a polish platen. The polishing pad 300 typically, though not necessarily, includes an inner area 302, which remains substantially unused during polishing, and an outer area 304, which predominantly contacts wafers during polishing.

The pad 300 generally includes openings, discussed in detail below, which define the cross-section open area of the pad 300. The openings may be disposed over the entire pad 300 or may be provided only in the outer area 304. The openings may take any of a number of different shapes. For instance, the openings may be grooves, circular openings, or openings of non-circular shape. By way of example, and not of limitation, the openings discussed herein are circular openings having diameters ranging from 1 to 1½ mm and center-to-center spacing ranging from 3 to 5 mm. The openings may also be formed in a pad in a number of different manners. For instance, the pad may be molded, stamped, punched or grooved with a desired configuration of openings. The characteristics, such as the arrangement and/or dimensions, of the openings typically vary with the depth of the pad to provide cross-sectional open areas which vary with depth. Within a region of interest, such as the outer pad area 304, the amount of open area may range from about 5% to 15% for many applications. The manner in which the cross-sectional open area of the pad varies with depth can vary depending on the particular polishing environment. While by no means exhaustive, FIGS. 4 through 17A–C illustrate some of the many different manners in which the open area of a pad may vary.

Figure 4:
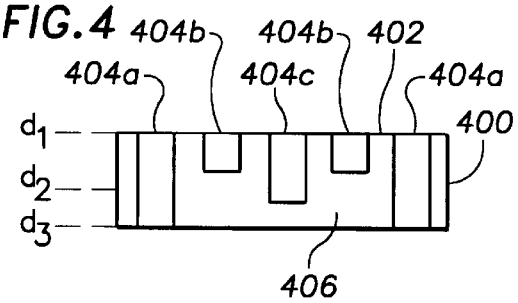
FIGS. 4 and 5A–C illustrate an exemplary pad in accordance with an embodiment of the invention.

FIG. 4 illustrates a partial, vertical cross-section of a pad 400 having a cross-sectional open area which varies with depth from the outer pad surface 402. In this embodiment, the pad 400 includes openings 404*a*, 404*b* and 404*c* which extend from the outer pad surface 402 into the pad body 406 by different amounts. The depths of the openings 404*a–c* will vary depending on the depth of the pad and the desired manner in which the open area will vary.

Figure 5A:
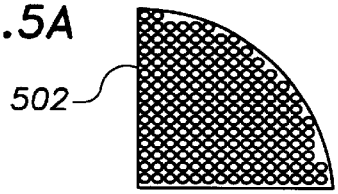
Figure 5B:
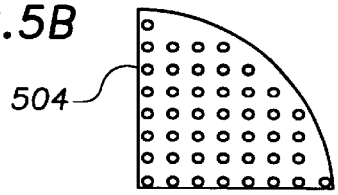
Figure 5C:
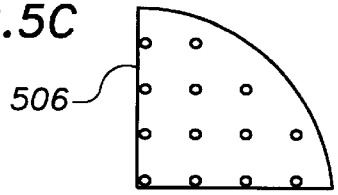

The varying depths of the openings 404*a–c* provides the pad 400 with a cross-sectional open area which decreases with pad depth. To illustrate, cross-sectional open areas 502, 504 and 506 of a representative portion of the pad 400 at depths $d_1$, $d_2$, and $d_3$ are shown in FIGS. 5A–5C, respectively. As can be seen the amount of open area at the various cross-sections 502–506 differs and, in this case, decreases with depth. In use, as the pad surface is removed, e.g., during conditioning, the cross-sections 502–506 of the pad 400 are exposed and the amount of open area of the pad 400 decreases. This may be beneficial in applications where the polishing pad 400 tends to polish the center of a wafer slower with time due to lack of polishing surface. In such a case, by decreasing the pad's open area (and thus increasing the pad's polishing surface area) over time, the polishing uniformity of the pad 400 and/or the useful life of the pad 400 can be increased.

Figure 6:
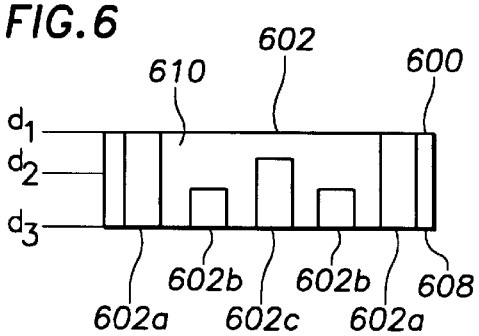
FIGS. 6 and 7A–C illustrate an exemplary pad in accordance with another embodiment of the invention.
Figure 7A:
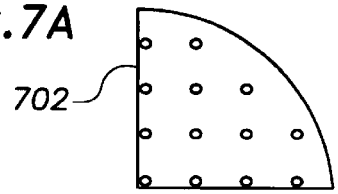
Figure 7B:
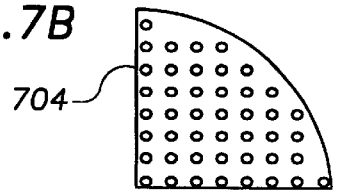
Figure 7C:
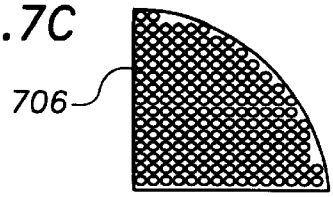
Figure 8:
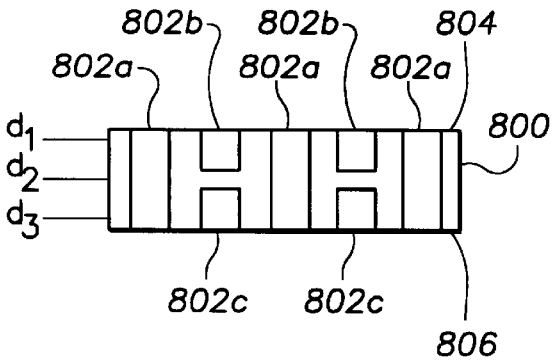
FIGS. 8 and 9A–C illustrate an exemplary pad in accordance with another embodiment of the invention.
Figure 10:
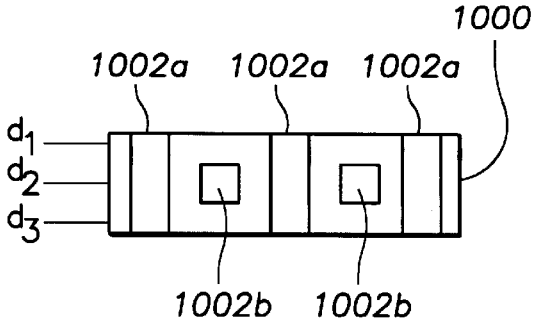
FIGS. 10 and 11A–C illustrate an exemplary pad in accordance with yet another embodiment of the invention.

FIG. 6 illustrates a partial, vertical cross-sectional of a pad 600 having a cross-sectional open area which increases with depth from the outer pad surface 602. The example pad 600 includes openings 602*a–c* which extend from the base 608 of the pad 600 into the pad body 610 by different amounts. In this case, the varying depth of the openings 602*a–c* provides the pad 600 with a cross-sectional open area which increases with pad depth. Cross-sectional open areas 702–706 of a portion of the pad 600 corresponding to depths $d_1$, $d_2$ and $d_3$ are shown in FIGS. 7A–7C, respectively. As can be seen, as the depth from the initial pad surface 602 increases, the open area of the pad 600 increases. Over time, this reduces the surface area of the pad 600 for polishing and also improves the ability to disburse slurry across the pad. This can, for example, enhance the polishing uniformity and/or extend the useful life of the pad, especially where poor slurry distribution detrimentally impacts the planarization efficiency of the pad 600 near the end of the pad's useful life.

Figure 9A:
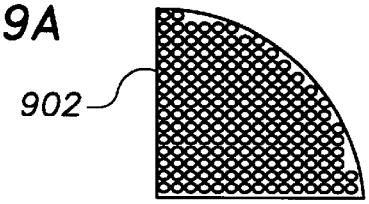
Figure 9B:
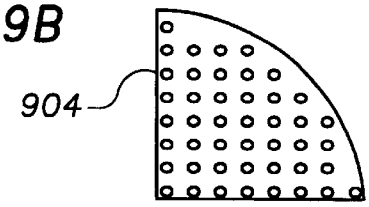
Figure 9C:
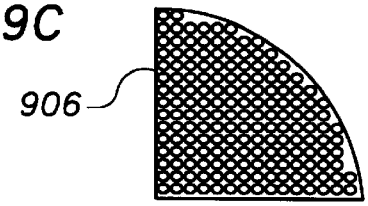

FIGS. 8 and 9A–9C illustrate an embodiment where the open area of a pad 800 decreases and then increases with pad depth. This exemplary pad 800 includes openings 802*a* which extend from the top surface 804 to the bottom surface 806 of the pad 800 as well as partial openings 802*b* and 802*c* which extend partially into the pad body from the top surface 804 and the bottom surface 806. To illustrate the change in open area of the pad 800, cross-sectional open areas 902–906 of a portion of the pad 800 corresponding to depths $d_1$, $d_2$ and $d_3$ are shown in FIGS. 9A–C, respectively. As can be seen, the pad 800 includes a first open area 902 at cross section $d_1$, a second, smaller open area 904 at cross-section $d_2$ and a third open area 906 at $d_3$ similar to the first open area 902 and larger than the second open area 902. In other embodiments, the third open area 906 may be greater than or less than the first open area 902. This may be done by, for example, changing the layout of the openings. This manner of varying open area can, for example, be useful where inefficient slurry distribution detrimentally impacts planarization efficiency at the beginning and end of the pad's useful life and/or where increased polishing surface is desirable during the middle portion of the pad life.

Figure 11A:
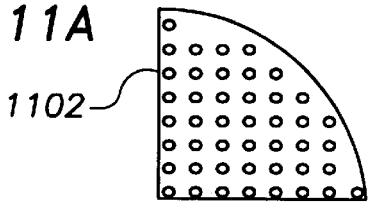
Figure 11B:
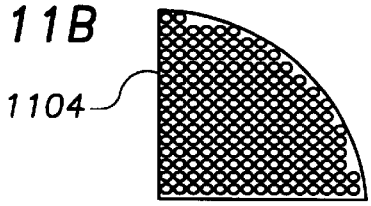
Figure 11C:
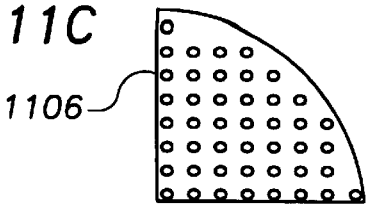

FIGS. 10 and 11A–C illustrate an embodiment where the open area of a pad 1000 increases in the middle of the pad 1000 and then decreases in a bottom portion of the pad 1000. In this embodiment, the pad 1000 includes openings 1002*a* which extend from the top surface 1004 to the bottom surface 1006 of the pad 1000 as well as openings 1002*b* embedded in the body of the pad 1000. To illustrate the change in open area of the pad 1000, cross-sections 1102–1106 of a portion of the pad 1000 at depths $d_1$, $d_2$ and $d_3$ are shown in FIGS. 11A–C. As can be seen, the pad 1000 includes a first open area 1102 at cross section $d_1$, a second, larger open area 1104 at cross-section $d_2$ and a third open area 1106 at $d_3$ similar to the first open area 1102 and smaller than the second open area 1104. As above, the third open area 1106 may be greater than or less than the first open area 1104 if desired. This embodiment can, for example, be useful where inefficient slurry distribution occurs during the middle portion of the pad life and/or where increased polishing surface is desired at the beginning and end of the pad's useful life.

Figure 13:
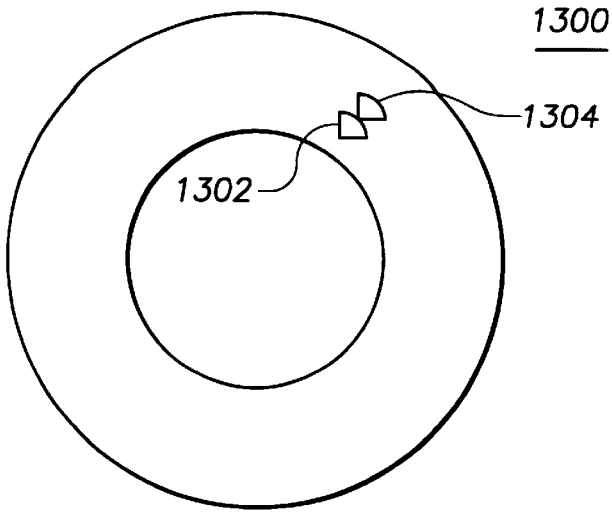
FIGS. 13–15, 16A–C and 17A–C illustrate an exemplary pad in accordance with still another embodiment of the invention.
Figure 14:
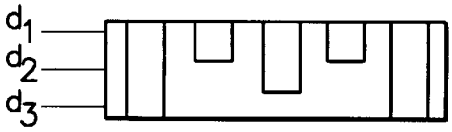
Figure 15:
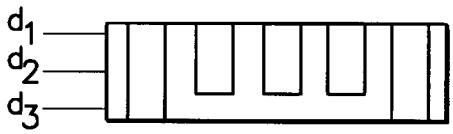
Figure 16A:
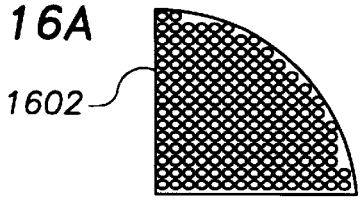
Figure 16B:
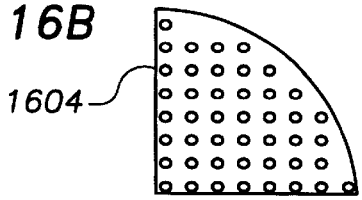
Figure 16C:
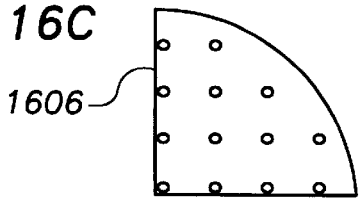
Figure 17A:
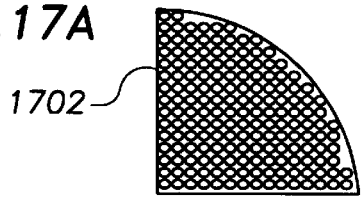
Figure 17B:
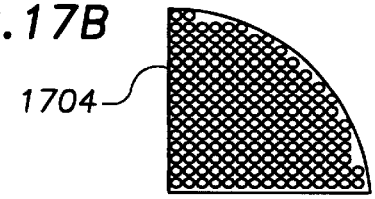
Figure 17C:
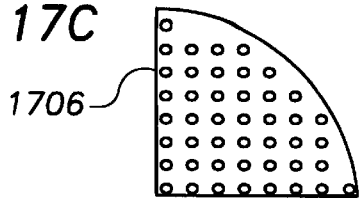

The cross-sectional open area of a pad may vary with depth differently in different regions of the pad. FIG. 13, for example, is a top view of a polishing pad 1300 having a cross-sectional open area which varies with radius as well as with depth. The pad 1300 includes at least two regions 1302 and 1304 which are associated with local cross-sectional open areas which vary differently with depth from the pad surface. FIGS. 14 and 15 illustrate partial vertical cross-sections of the pad portions 1302 and 1304. FIGS. 16A–16C and 17A–17C illustrate horizontal cross-sectional open area 1602–1602 and 1702–1706 of the pad portions 1302 and 1304 at depths $d_1$, $d_2$ and $d_3$, respectively. As illustrated, the open areas 1602–1606 and 1702–1706 of the pad portions 1302 and 1304 start the same with the open areas 1602–1606 of pad portion 1302 decreasing faster with pad wear.

Figure 20:
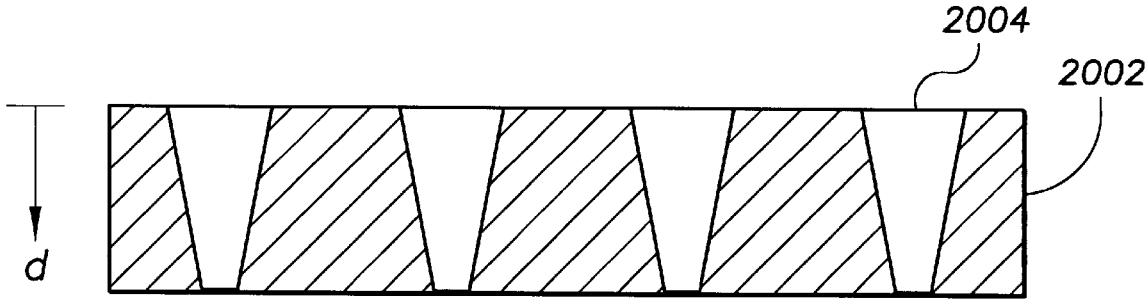
FIG. 20 illustrates an exemplary pad cross-section in accordance with another embodiment of the invention.

The above embodiments illustrate some of many different manners in which the open area of a pad may vary. The invention is not limited to the above embodiments but extends to cover any type of pad which has a cross-sectional open area which varies with depth from the pad surface. For example, while the above embodiments illustrate discrete variations in cross-sectional open area using circular openings of constant diameter and different depths, the invention is not so limited. For instance, the shape (e.g., diameter) of the openings may vary with pad depth so as to vary the open area of the pad. FIG. 20 illustrates, by way of example, a partial vertical cross-section of a polishing pad 2002 having openings 2004 with diameters which vary with distance d from pad surface 2006.

Figure 18:
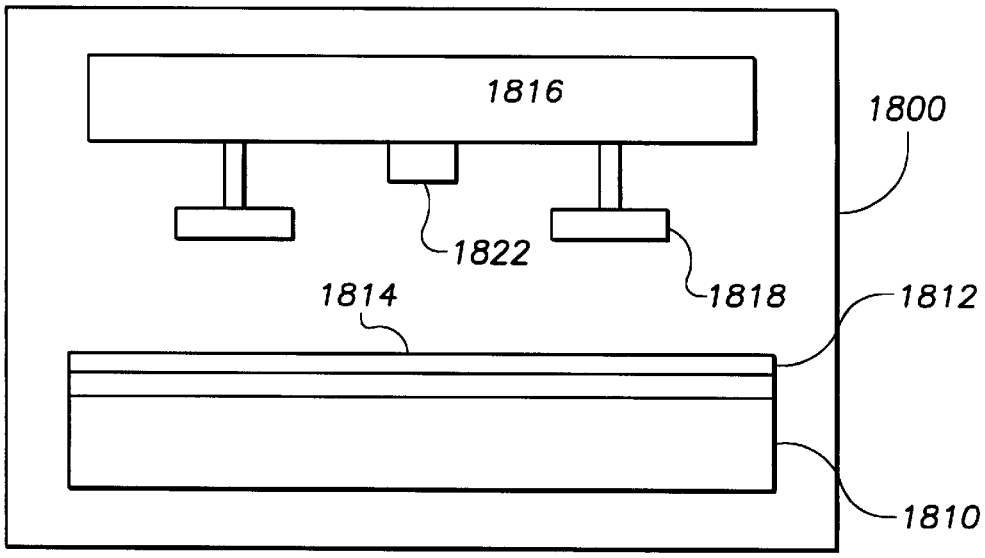
FIG. 18 illustrates an exemplary polishing tool in accordance with a further embodiment of the invention.

FIG. 18 illustrates an exemplary chemical-mechanical polishing system having a polishing pad in accordance with one embodiment of the invention. The CMP polishing system 1800 generally includes a platen 1810 on which is mounted a polishing pad 1812 having a cross-sectional open area which varies with depth from the pad surface 1814. The cross-sectional open area of the pad may vary in a manner similar to the pads discussed above. The illustrated CMP system 1800 further includes a multi-head carrier 1816 positioned above the platen 1810. The multi-head carrier 1816 includes a plurality of rotatable carrier heads 1818 on which semiconductor wafers can be secured using known techniques such as vacuum pressure. A source of polishing fluid 1822 is provided to supply polishing fluid to the pad 1812 for polishing. While a multi-head chemical-mechanical polishing system is shown in the illustrative embodiment of FIG. 18, as noted above, any type of polishing system, including single-head systems, using a polishing pad having cross-sectional open areas which vary with depth may be employed.

Figure 19:
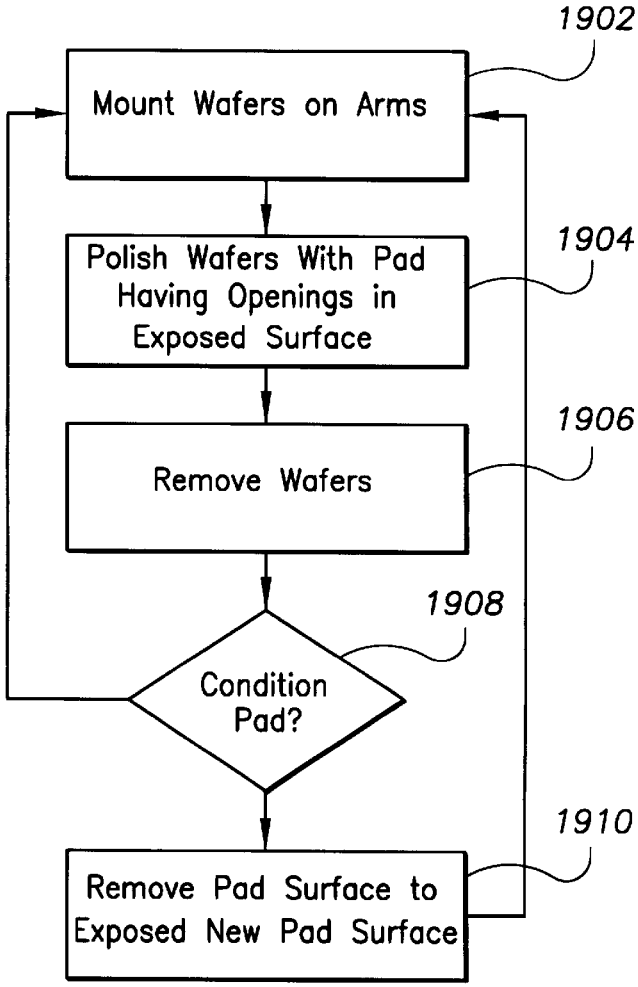
FIG. 19 is a flow chart illustrating an exemplary method in accordance with an embodiment of the invention.

FIG. 19 is a flow chart illustrating an exemplary method of polishing semiconductor wafers using a polishing pad having cross-sectional open areas which vary with pad depth. The method may, for example, be carried out using the CMP system 1800 shown in FIG. 18. It will be appreciated, however, that this method can readily be applied to any type of polishing system using a polishing pad. The method includes first mounting a wafer on each head of a CMP tool, as indicated at block 1902. This may, for example, be performed after breaking-in the polishing pad over one or more polishing runs.

Next, the wafers are polished using the polishing pad as indicated at block 1904. This typically includes pressing the wafers against the polishing pad and applying a slurry as discussed above. The wafers are then removed from the CMP tool, as indicated at block 1906. After the wafers are removed, the pad may be conditioned as indicated at blocks 1908 and 1910. Typically, the pad is conditioned after one or more groups of wafers are polished and removed from the tool. The conditioning, indicated at block 1910, typically includes removing portions of the pad to expose a new surface of the pad. As pad material is removed, the thickness of the pad will decrease and the open area of the pad will change consistent with the configuration of the openings in the pad. Accordingly, as the pad is used, the open area of the pad varies. As noted above, by varying the open area of a pad over time, the planarization efficiency can be improved and the useful life of the pad may be extended.

In summary, the present invention is applicable a number of different types of polishing systems which employ polishing pads which would benefit from having an open area which can vary with pad life. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art upon review of the present specification. The claims are intended to cover such modifications and devices.

What is claimed is:

1. A polishing pad arrangement, comprising a pad having a horizontal polishing surface and a plurality of openings that define a horizontal cross-sectional open area of the pad, the horizontal cross-sectional open area being taken across the pad in a horizontal plane that is substantially parallel to the horizontal polishing surface, each of the plurality of openings having a substantially consistent horizontal cross-section throughout the opening, at least a portion of the horizontal cross-sectional open area of the pad increasing as the distance from the horizontal polishing surface at which the horizontal cross-sectional open area is taken increases, and wherein the plurality of openings include X openings located at a first depth measured from the horizontal polishing surface, and Y openings located at a second depth measured from the horizontal polishing surface, the first depth being less than the second depth, wherein the X openings have a combined horizontal cross-sectional open area that is less than a combined horizontal cross-sectional open area of the Y openings.

2. The polishing pad arrangement of claim 1, wherein the horizontal cross-sectional open area of the pad includes a first open area relative to the horizontal polishing surface and a second open area further from the horizontal polishing surface than the first open area, the first open area being greater than the second open area.

3. The polishing pad arrangement of claim 2, wherein the horizontal cross-sectional open area of the pad includes a third open area further from the horizontal polishing surface than the second open area, the third open area being greater than the second open area.

4. The polishing pad arrangement of claim 2, wherein the horizontal cross-sectional open area of the pad includes a third open area further from the horizontal polishing surface than the second open area, the third open area being less than the second open area.

5. The polishing pad arrangement of claim 1, wherein the horizontal cross-sectional open area of the pad includes a first open area at a first horizontal cross-section relative to the horizontal polishing surface and a second open area at a second horizontal cross-section further from the horizontal polishing surface than the first horizontal cross-section, the first open area being less than the second open area.

6. The polishing pad arrangement of claim 5, wherein the horizontal cross-sectional open area of the pad includes a third open area further from the horizontal polishing surface than the second open area, the third open area being greater than the second open area.

7. The polishing pad arrangement of claim 5, wherein the horizontal cross-sectional open area of the pad includes a third open area further from the horizontal polishing surface than the second open area, the third open area being less than the second open area.

8. The polishing pad arrangement of claim 1, wherein the pad includes at least a first section and a second section each having a local horizontal cross-sectional open area which varies with depth from the horizontal polishing surface, wherein the local horizontal cross-sectional open area of the second section varies with depth differently than the local horizontal cross-sectional open area of the first section.

9. The polishing pad arrangement of claim 1, wherein the pad includes a central axis and first and second sections spaced radially by different distances from the central axis, the first and second sections having local horizontal cross-sectional open areas which differ at the same depth from the horizontal polishing surface.

10. The arrangement of claim 1, further comprising a rotatable polishing platen.

11. The arrangement of claim 1, wherein another portion of the horizontal cross-sectional open area decreases with distance from the horizontal polishing surface.

12. The polishing pad arrangement of claim 1, wherein the number of Y openings is greater than the number of X openings.

13. The polishing pad arrangement of claim 1, wherein the horizontal cross-sectional open area of the X and Y openings are all substantially equal.

14. The polishing pad arrangement of claim 1, wherein the horizontal cross-sectional open area of at least one of the Y openings is greater than the horizontal cross-sectional open area of at least one of the X openings.

15. A system for polishing semiconductor wafers, comprising:

a polishing platen;

a motor for rotating the polishing platen;

a polishing pad mounted on the polishing platen, the pad having a horizontal polishing surface and a plurality of openings that define a horizontal cross-sectional open area of the pad, the horizontal cross-sectional open area being taken across the pad in a horizontal plane that is substantially parallel to the horizontal polishing surface, each of the plurality of openings having a substantially consistent horizontal cross-section throughout the opening, at least a portion of the horizontal cross-sectional open area of the pad increasing as the distance from the horizontal polishing surface at which the horizontal cross-sectional open area is taken increases, wherein the plurality of openings include X openings located at a first depth measured from the horizontal polishing surface, and Y openings located at a second depth measured from the horizontal polishing surface, the first depth being less than the second depth, wherein the X openings have a combined horizontal cross-sectional open area that is less than a combined horizontal cross-sectional open area of the Y openings; and a source of polishing fluid adapted for providing polishing fluid to the polishing pad.

16. The system of claim 15, wherein the horizontal cross-sectional open area of the pad includes a first open area relative to the horizontal polishing surface and a second open area further from the horizontal polishing surface than the first open area, the first open area being greater than the second open area.

17. The system of claim 15, wherein the horizontal cross-sectional open area of the pad includes a first open area at a first horizontal cross-section relative to the horizontal polishing surface and a second open area at a second horizontal cross-section further from the horizontal polishing surface than the first horizontal cross-section, the first open area being less than the second open area.

18. The system of claim 15, wherein the pad includes at least a first section and a second section each having a local horizontal cross-sectional open area which varies with depth from the horizontal polishing surface, wherein the local horizontal cross-sectional open area of the second section varies with depth differently than the local horizontal cross-sectional open area of the first section.

19. The system of claim 15, wherein the pad includes a central axis and first and second sections spaced radially by different distances from the central axis, the first and second sections having local horizontal cross-sectional open areas which differ at the same depth from the horizontal polishing surface.

20. The system of claim 15, wherein the openings have different dimensions.

21. The system of claim 20, wherein the openings have different depths.

22. The system of claim 15, wherein another portion of the horizontal cross-sectional open area decreases with distance from the horizontal polishing surface.

23. A polishing pad arrangement comprising a pad having a horizontal polishing surface and a plurality of openings located in the pad, each of the plurality of openings being defined by substantially vertical sidewalls defining a perimeter of the opening, the plurality of openings defining a horizontal cross-sectional open area of the pad at horizontal cross-sections taken through the pad, the horizontal cross-sections being substantially parallel with the horizontal polishing surface, wherein a horizontal cross-sectional open area of at least a portion of the pad increases as the distance between horizontal cross-sections taken and the horizontal polishing surface increases, and wherein the plurality of openings include X openings located at a first depth measured from the horizontal polishing surface and Y openings located at a second depth measured from the horizontal polishing surface, the first depth being less than the second depth, wherein the X openings have a combined horizontal cross-sectional open area that is less than a combined horizontal cross-sectional open area of the Y openings.

* * * * *